United States Patent [19]

Gallant

[11] 4,236,285

[45] Dec. 2, 1980

[54] CURVED ROLL HAVING SEALED TORSIONAL COUPLING BETWEEN ROLL SECTIONS

[75] Inventor: James O. Gallant, Rehobeth, Mass.

[73] Assignee: SW (Delaware), Inc., Providence, R.I.

[21] Appl. No.: 869,137

[22] Filed: Jan. 13, 1978

[51] Int. Cl.[3] ..... D06C 3/06

[52] U.S. Cl. ..... 26/103

[58] Field of Search ..... 26/102, 103, 104; 29/116 R, 116 AD; 198/824

[56] References Cited

FOREIGN PATENT DOCUMENTS 2110079 9/1972 Fed. Rep. of Germany ..... 26/104

15987 of 1914 United Kingdom ..... 26/103

*Primary Examiner*—Robert Mackey

*Attorney, Agent, or Firm*—Kenway & Jenney

[57] ABSTRACT

A curved roll with a longitudinally-curved axle which supports roll sections or spools by way of roller bearings seated on the axle has a flexible torque coupling between adjacent spools. Each coupling flexes to accommodate the curvature of the roll and both seals lubricant within the roll from leakage and seals dirt and other external contaminants from the roll interior. Each coupling employs a tubular coupling element which mechanically seats at each axial end within a circumferential channel internally recessing the spool end. Axially-extending members on each spool engage the coupling element for ensuring positive torque tranfer between the adjacent spools.

3 Claims, 4 Drawing Figures

FIG. 1
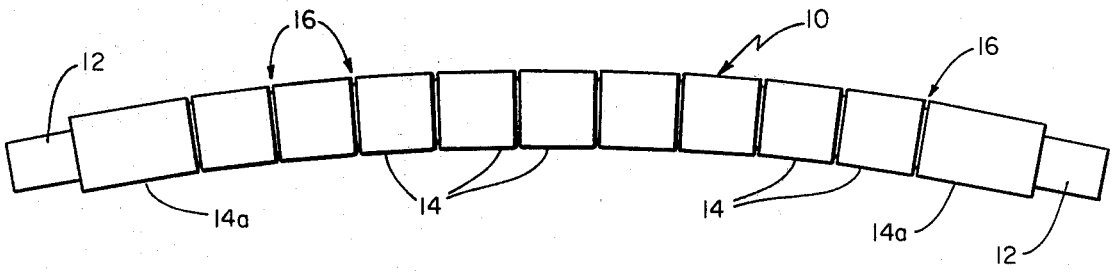
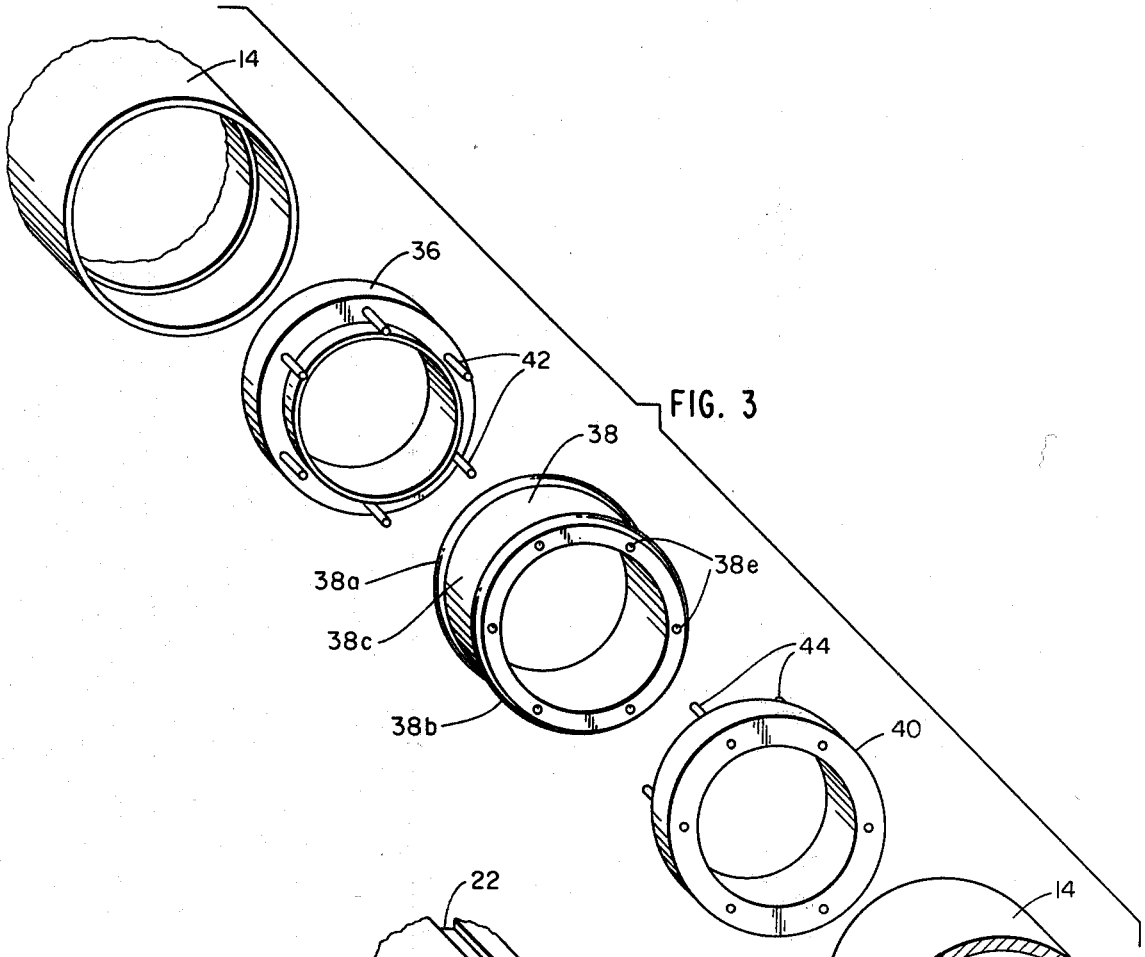
FIG. 3
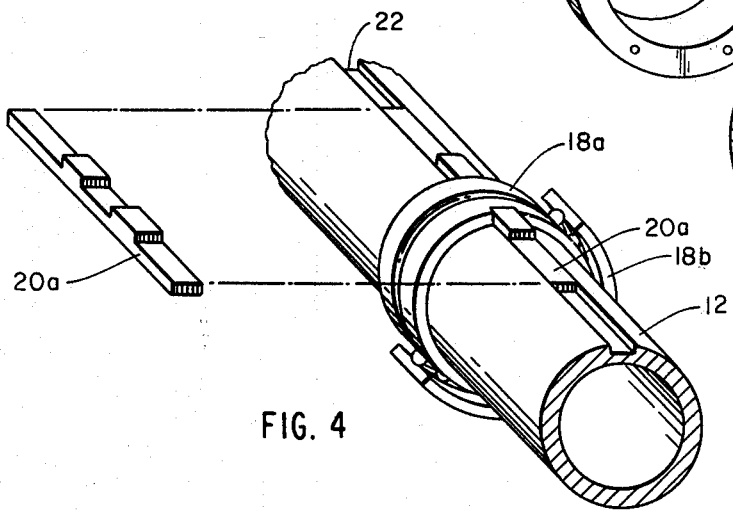
FIG. 4

CURVED ROLL HAVING SEALED TORSIONAL COUPLING BETWEEN ROLL SECTIONS

BACKGROUND OF THE INVENTION

This invention relates to curved rolls useful in the treatment of flexible webs and sheets. Such rolls have a bowed or curved axle which supports individual cylindrical tube sections or spools by way of roller bearings seated on the axle. The invention in particular provides such a roll having improved flexible couplings between the spools.

Curved rolls are employed in various industries for laterally expanding or contracting materials such as cloth, paper, plastic film, metal foil, tire cord webs and the like to remove wrinkles or to draw the sheet or web to a predetermined width. The rolls are also used for correcting the bow or curvature of weft elements in woven materials, and for controlling and guiding the path of webs and sheets in a processing plant.

When a curved roll is used without a resilient covering or sleeve over the spools; dirt, fibers, liquids, and other material external to the roll are to be sealed from the interior of the roll where they would degrade the bearings. Similarly, lubricant such as oil or grease within the roll for the bearings is to be sealed from leaking to the roll surface, where it would be lost from the bearings in addition to soiling the material running over the roll.

Further, the spools of such a roll are to be coupled torsionally to rotate together, but with flexibility to conform to the bow or curvature of the axle, the assemblage of spools is to rotate smoothly and without significant vibration or wobble at high speeds.

A prior effort to provide a roll structure which satisfies the foregoing objectives as set forth in United Kingdom Patent Specification No. 1,346,196 (which corresponds to German Pat. No. 1,635,360), couples each pair of adjacent spools with a flexible tubular coupling element having a metal bush in its interior bore. Each coupling element is telescopically seated within, and cemented or bonded to, the ends of the spools it interconnects. One shortcoming of this structure is a relatively high resistance of the roll to rotation, i.e. the roll has a relatively high torque requirement. This is due to a loss of energy in each coupling element as it is repeatedly deformed due to mechanical interactions with the skewed spools pressed against its outer surface and with the metal bush within it.

It is also known to couple the spools of a curved roll with a resilient elastic collar pressed within the spool ends and receiving at each end a series of drive pins fixed to the respective spools. However, this coupling structure tends to leak.

Accordingly, it is an object of this invention to provide an improved construction for a curved roll suitable for use without a sleeve or covering over the spools.

A further object of the invention is to provide a flexible torque coupling between the spools of a curved roll which seals material within the roll from leakage between the spools, and which seals the interior of the roll from external materials.

Another object of the invention is to provide a curved roll having a coupling of the above character and wherein the spools are in continuous positive torsional engagement with one another for smooth low-wear rotation at relatively high speeds. By way of example, rolls of the present type are subject typically to operation at high speeds in the order of 4,500 revolutions per minute.

It is also an object of the invention to provide a curved roll of the above character capable of sustained operation under adverse environmental conditions for relatively long periods of time. Attainment of this objective reduces maintenance and replacement of rolls. Adverse environmental conditions under which rolls typically operate, in addition to high rotational speeds, include exposure to corrosive fluids and to high temperatures. By way of example rolls at the wet end of a paper-making machine are exposed to the corrosive liquids present with ground wood paper stock, and rolls at the drier section are exposed to air or other drying gas at temperatures reaching as high as 300° Fahrenheit. Other adverse conditions include the use of kerosine or like solvents for washing down paper-making equipment, and the presence of ozone under certain operating conditions.

The invention also has as an object to provide a roll having a relatively low resistance to rotation. Such a roll requires a relatively low rotational drive torque. In addition to yielding increased economy, this has the advantage of increasing the stretching or other treatment or control which the roll can impart to a web or sheet passing around it.

Other objects of the invention will in part be obvious and will in part appear hereinafter.

GENERAL DESCRIPTION

A curved roll according to the invention has the conventional structure of an axle on which roller bearings are mounted and with an axial succession of cylindrical roll sections or spools mounted on the bearings. Typically, there is a single bearing for each spool. A coupling between adjacent ones of at least a plurality of the spools transfers torque between the spools and seals the gap between the spools both to isolate the interior of the roll from materials present in the environment and to retain lubricant within the roll. Each coupling employs a resiliently flexible tubular coupling ring which telescopically fits within the opposed ends of the two spools. Sealing members on each spool radially clamp the axial ends of the coupling ring fitted therein for sealing the ring to the spools and thereby sealing the gap between the spools. The engagement of the coupling ring with the sealing members can transfer torque through the coupling, but it is preferred to transfer torque between the coupled spools by way of axially-extending torqueing elements on each spool and which engage the coupling ring. The torque-transferring engagement of the coupling ring with the torqueing elements is readily introduced, as is advantageous, at a location spaced from the sealing engagement of the ring with the spools.

In the preferred embodiment described below, each sealing member provides a circumferential channel adjacent a spool end and axially facing the channel on the next spool. The ends of the coupling ring fit within these facing circumferential channels with radial compression. Further, the structure of the coupling is such that the coupling ring is substantially free of engagement with other elements along the central portions of its tubular inner and outer surfaces, i.e. at locations other than at the axial ends which are compressively seated within the circumferential channels. Each face of the coupling ring is recessed with a series of circumferentially-spaced apertures, and sets of torque-transferring pins projecting from the base of each circumferential channel seats within these apertures. The apertures recessing one face of the coupling ring are circumferentially offset from those in the other face, so that the two sets of pins which engage opposite sides of the coupling ring are circumferentially interleaved with one another.

This construction for the coupling between spools of a curved roll provides a secure seal of the gaps between the spools to confine lubricant within the roll and to exclude material such as dirt, fibers, wash liquids, and other potentially deleterious solids and fluids from entering the roll. The coupling, in addition, provides secure positive torque transmittal between the spools and in a manner which is essentially free of mechanical vibration, wobble or wear, even at the high speeds typically encountered in the field.

Moreover, a curved roll employing the new couplings has an unusually low resistance to rotation, so that it rotates readily. The invention attains this result because the resiliently-flexible coupling rings are subjected to minimal strain per unit length as the roll rotates and hence there is a minimal energy loss in them. In addition, stresses within the coupling ring are well distributed to diminish wear and fatigue. A further feature of the roll is that the seals which the couplings provide between the spools are not dependent on adhesive attachment or bonding, but rather stem from secure mechanical engagements, i.e. radial compression of the ends of the coupling rings within the circumferential channels. Also, the coupling rings are suitable for manufacture of material resistant to the deleterious materials encountered in the use of these rolls.

The invention thus makes possible a curved roll that can operate without an outer sleeve or other covering without loss of internal lubricant and without introduction of contaminants to the roll interior, and which rotates with low resistance. The gaps between the roll spools are sufficiently small to be insignificant in many applications. The roll can, of course, be used with an outer covering or sleeve with the advantage that the sealing and torque-transferring features substantially minimize the requirements typically imposed upon such an outer covering or sleeve.

The invention accordingly comprises the features of construction, combination of elements, and arrangement of parts exemplified in the construction hereinafter set forth, and the scope of the invention is indicated in the claims.

For a further understanding of the nature and objects of the invention, reference should be had to the following detailed description taken in connection with the accompanying drawings, in which:

FIG. 1 is a plan view of a curved roll;

FIG. 3 is an axially exploded view of a portion of the curved roll of FIG. 2; and FIG. 4 is a fragmentary isometric view of a section of the roll structure of FIG. 2

DESCRIPTION OF ILLUSTRATED EMBODIMENT

Figure 2:
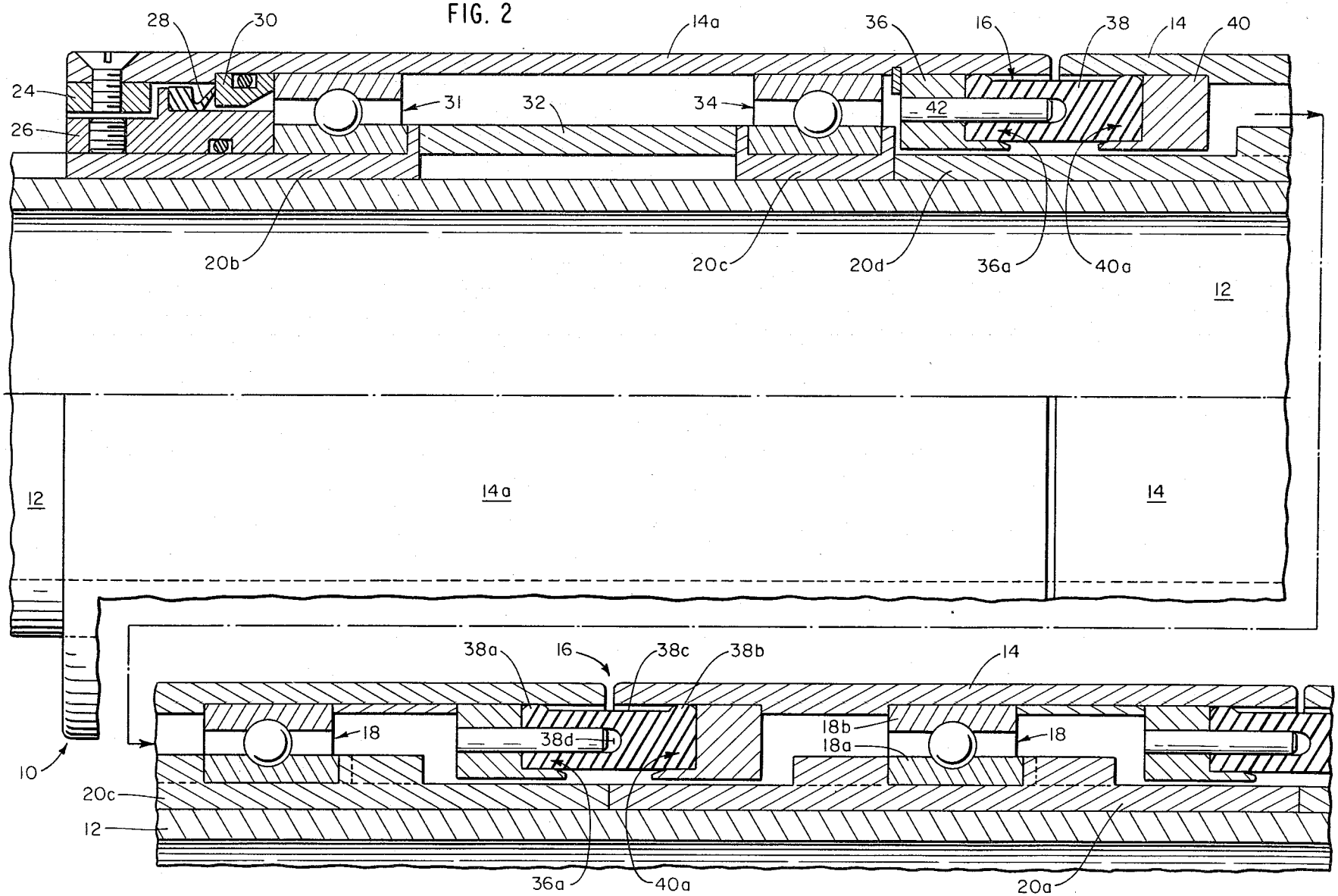
FIG. 2 is a fragmentary view, largely broken away, of a curved roll as shown in FIG. 1 and embodying the invention.

A curved expander or stretching roll 10 shown in FIG. 1 has a rigid longitudinally-curved non-rotating axle 12 on which an axial succession of rotatable spools 14 are mounted. The spools are mounted on the axle 12 by way of roller bearings as shown and described below with reference to FIG. 2. Couplings 16 span the gaps between adjacent spools 14 and both seal these gaps and transfer rotational movement from one spool to the next. Because of the bow or longitudinal curvature of the roll, each gap has a minimal value at the inside of the curve and a maximal value at the outer side of the curve. Correspondingly, one side of each coupling is under compression, whereas the other side is in tension. The sites of these conditions of tension and compression within each coupling 16 change as the coupling rotates with the rotating spools. Thus, during operation of the roll, each point within a coupling is alternately compressed and tensioned at the frequency of roll rotation. However, the roll which the invention provides develops a minimal level of energy loss due to the repeated variation in stresses at the couplings, and hence provides superior operation and performance.

The roll 10, as appears from the detailed view of one end in FIG. 2, mounts the spools 14 on the axle 12 with roller bearings 18, 18. Each bearing inner race **18*a* is keyed to the axle 12 and each outer race 18*b* is secured as by a press fit within a spool 14. FIG. 4 shows that bearing-engaging keys 20 seat in an axial slot 22 which recesses the axle 12. The roll 10 employs four kinds of keys 20*a*, 20*b*, 20*c* and 20*d*, and FIG. 4 shows with specific reference to a common key 20*a* that each key 20*a* seatingly engages a bearing inner race between two upstanding lugs one of which fits within a keyway on a radial face of the inner race. This construction rotationally fixes each bearing inner race to the roll axle. Further, as FIG. 2 shows, the illustrated roll has a single common key 20*a* for each spool (other than the two spools at each end of the roll) and it extends axially half way into each inter-spool gap to abut the next key. The common keys 20*a*, together with two keys 20*d*, and two keys 20*c***, thereby fix the axial spacings of the spools.

The end of the roll 10 in the illustrated construction of FIG. 2 has a generally conventional arrangement with an annular end cap 24 secured within the end spool **14*a*, an annular sealing ring 26 fixed with the axle and mounting an annular elastomeric V-seal 28. The end spool carries a sealing race 30 which engages the lip of the V-seal throughout rotation to seal the end of the roll. An end key 20*b* is fixed to the axle 12 and both fixes the sealing ring 26 and locates an end bearing 31. A cylindrical spacer 32 axially interior of the end key 20*b* locates a bearing key 20*c* which secures a second end bearing 34 within the end spool 14*a*. As FIG. 2 further shows, the next key 20*d* is identical to a common key 20*a* as shown in FIG. 4 except that it extends axially beyond the common spool 14 which it mounts to within the end spool 14*a*, where it bears against and thereby locates the bearing key 20*c*. Thus, aside from a spool 14*a* at each end, the illustrated roll 10 has identical spools 14 each mounted on one bearing 18 and located by identical common keys 20*a* except for the next-to-the-end spool which employs a spacer key 20*d***.

Turning to the couplings 16 between adjacent spools and referring to FIGS. 2 and 3, each has—in axial succession—a first sealing and support ring 36, a coupling ring 38, and a second sealing and support ring 40. The illustrated sealing and support rings 36 and 40, typically of metal like the spools, are fabricated separate from the spools 14, and each is telescopically press fitted within the end of a spool for substantially permanent attachment thereto. Thus, as shown, the end spool **14*a* carries a sealing and support ring 36**, and each common spool 14 carries a sealing and support ring 40 at one end and a like ring 36 at the other end. (The sealing and support rings 36 and 40 can as an alternative be fabricated integral with the spools.)

Each ring 36, 40 forms, with a spool inner surface, a circumferential channel 36*a*, 40*a*, respectively, nested within the spool closely spaced from an end and axially-facing toward that spool end. Thus there is a channel 36*a* of one spool facing a channel 40*a* of the next spool at each inter-spool gap. The channels are radially dimensional to receive one end of a coupling ring 38 with an interference fit and are sufficiently deep axially to securely seat and clamp that end of the coupling ring 38.

Each sealing ring 36, 40 carries torque-transferring members which engage the coupling ring 38. In the illustrated roll, the torque-transferring members are a set of axially-projecting pins 42, 44 fixed to each ring 36, 40 respectively, at the base of the channel which it forms and projecting along the depth of the channel. The illustrated pins project entirely through the depth of each channel and beyond; the pins 42, 44 shown project to the axial end of the spool 14 on which they mount. Thus, at each coupling 16, a set of pins 42 axially projects toward a set of pins 44. In the illustrated arrangement, the two opposed sets of pins do not axially overlap but rather their opposing ends are spaced apart by the same distance as the ends of the adjacent spools. The torque-transmitting pins can, however, be made with other relative lengths within the scope of this invention.

The coupling ring 38 interconnects the two sealing and support rings at a coupling with the two sets of pins circumferentially interleaved, as will now be described with continued reference to FIGS. 2 and 3. Each coupling ring 38 is a resiliently-flexible tubular ring or cylindrical tube preferably of elastomeric material. The coupling ring has sufficient hardness and strength to effect the desired seal with the spools and to carry and transmit torsional loads as required, but it is not so hard as to wear and deteriorate when repeatedly flexed as occurs during operation of a roll: An illustrative preferred material for the coupling ring 38 is an epichlorohydrin synthetic elastomer, such as is marketed under the term HERCLOR H, having a Shore A hardness typically in the range of between fifty-five and sixty-five.

A further feature is that the coupling ring 38 is arranged to be relatively free of constraint by other structure along its inner and outer tubular surfaces other than where it engages the spool-carried channels 36*a* and 40*a*. These engagements are at the axial ends of the ring 38, so that at least half or more of the axial span of the coupling ring is free of external restraint along its inner and outer circumferential tubular surfaces, as FIG. 2 shows. The illustrated construction provides this by limiting the axial engagement of the tubular inner surface of the ring 38 within each channel, i.e. by limiting the depth of each circumferential channel along the inner tubular surface of the coupling ring 38. Further, the coupling ring has a gasket-like sealing rim 38*a*, 38*b* radially bulging outward at each axial end. It is this rim, which extends in continuous unbroken fashion around the outer peripheral circumference of the coupling ring, which compressively seats within the radially outermost wall of each channel 36*a* and 40*a*. The intermediate portion 38*c* of the outer tubular surface consequently is radially spaced within, and hence free of engagement with, the spool ends or other structure.

One reason for leaving the central portions of the tubular inner and outer surfaces of each coupling ring free of restraining engagement with other elements is to minimize the restraint on flexing and other deformation of each coupling ring during operation of a roll. There consequently is minimal energy loss in each coupling ring. The roll as a result operates with minimal wear and with minimal resistance to rotation.

Each axial face of each coupling ring 38 is recessed with a set of pin-receiving holes 38*d*, 38*e*, respectively, for seatingly receiving the projecting torque-transferring pins 42 and 44. As noted, and as FIG. 3 shows with the relative rotational positions of the sealing rings 36 and 40, the pin-receiving apertures 38*d* on one face are circumferentially offset from the apertures 38*e* recessing the coupling ring from the other face. Thus, the strains produced within a coupling ring by each pin are spaced from the strains produced by other pins.

With the foregoing construction, each coupling ring is subjected to only finite strains during roll operation, and this strain is distributed over a relatively large volume of the elastomeric or other material of the coupling ring so the strain density is relatively low throughout the ring. Further, during roll operation the coupling ring is subjected to frictional restraint or rubbing only at the small area within each aperture 38*d*, 38*e* which engages a coupling pin and at the small circumferential end areas compressed within the channels 36*a* and 40*a*. Flexing of the ring 38 at the former areas is slight, and there is even less at the latter areas.

By way of illustrative example, for a six-inch diameter roll, the coupling ring 38 has six holes 38*d* and 38*e*, is 1.75 inches long, has an inner diameter of 4.625 inches, has a radial thickness at the surface portion 38*c* of 0.547 inch, and each rim 38*a* and 38*b* radially projects by 0.078 inch when unrestrained. The sealing rings 36, 40 which seat this coupling ring have a channel with an inner diameter of 4.625 inches and a radial width of 0.593 inch. Thus, there is an interference between the uncompressed coupling ring and the channel into which it is to be seated of 0.032 inch.

It will thus be seen that the foregoing structure of a curved roll efficiently attains the objects set forth, including those made apparent from the preceding description. Certain changes may be made in the above construction without departing from the scope of the invention using conventional skill regarding web and sheet processing rolls as known to those skilled in this art, and accordingly it is intended that all matter contained in the above description or shown in the accompanying drawings is to be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described the invention, what I claim as new and desire to secure by Letters Patent is:

1. A curved roll having an axle, a series of bearings received on said axle and axially spaced apart therealong, roll sections rotatably supported on said bearings, spacer means arranged along said axle extending between said bearings, and couplings joined between pairs of adjacent roll sections, said roll having the improvement comprising A. means forming a circumferential channel within each coupled roll section and rotating with that roll section, said channel means being spaced from and axially facing a proximate axial end of the roll section, B. torque-transferring means within each coupled roll section and rotating with that roll section, said torque-transferring means axially projecting adjacent a proximate end of the roll section in the direction toward said end, and C. a resiliently-flexible tubular coupling element axially spanning between two adjacent coupled roll sections, each said coupling element having a tubular central portion axially intermediate two tubular end portions and being seated and radially compressively engaged only at each said end portion within said circumferential channels on the two coupled roll sections and being in torque-transferring engagement with said torque-transferring means on the coupled roll sections.

2. A curved roll according to claim 1 wherein each said coupling element is free of externally-applied restraining engagement at the tubular inner and outer surfaces thereof throughout said central portion.

3. A curved roll having an axle, a series of bearings received on said axle and axially spaced apart therealong, roll sections rotatably supported on said bearings, spacer means arranged along said axle extending between said bearings, and couplings joined between pairs of adjacent roll sections, said roll having the improvement comprising A. means forming a circumferential channel within each coupled roll section and rotating with that roll section, said channel means being spaced from and axially facing a proximate axial end of the roll section, B. torque-transferring means within each coupled roll section and rotating with that roll section, said torque-transferring means axially projecting adjacent a proximate end of the roll section in the direction toward said end, and C. a resiliently-flexible tubular coupling element axially spanning between two adjacent coupled roll sections, each said coupling element being a tubular ring having a central portion axially intermediate end portions and being seated and radially compressively engaged only at said end portions within said circumferential channels on the two coupled roll sections and being in torque-transferring engagement at said central portion with said torque-transferring means on the coupled roll sections.

* * * * *